US010596070B2

(12) United States Patent
Wurst et al.

(10) Patent No.: US 10,596,070 B2
(45) Date of Patent: Mar. 24, 2020

(54) DEVICE AND METHOD FOR EJECTING AT LEAST ONE CAPSULE FROM A CAPSULE HOLDER

(71) Applicant: Harro Hoefliger Verpackungsmaschinen GmbH, Allmersbach im Tal (DE)

(72) Inventors: Reiner Wurst, Allmersbach im Tal (DE); Timo Kuehnert, Allmersbach im Tal (DE)

(73) Assignee: Harro Hoefliger Verpackungsmaschinen GmbH, Allmersbach im Tal (DE)

( * ) Notice: Subject to any disclaimer, the term of this patent is extended or adjusted under 35 U.S.C. 154(b) by 0 days.

(21) Appl. No.: 15/991,805

(22) Filed: May 29, 2018

(65) Prior Publication Data

US 2018/0271750 A1 Sep. 27, 2018

Related U.S. Application Data

(63) Continuation of application No. PCT/EP2015/002379, filed on Nov. 26, 2015.

(51) Int. Cl.
*A61J 3/07* (2006.01)
*B65B 5/10* (2006.01)
(Continued)

(52) U.S. Cl.
CPC ..... *A61J 3/074* (2013.01); *B65B 5/103* (2013.01); *B65B 7/2807* (2013.01); *B65B 57/20* (2013.01)

(58) Field of Classification Search
CPC .. A61J 3/07; A61J 3/074; B65B 5/103; B65B 7/2807; B65B 57/20
(Continued)

(56) References Cited

U.S. PATENT DOCUMENTS 289,397 A * 12/1883 Dietz ..... B28B 5/025 425/220
4,265,072 A * 5/1981 Egli ..... B65B 57/20 193/46
(Continued)

FOREIGN PATENT DOCUMENTS

CN 108309803 * 7/2018 ..... B07C 5/10
DE 102010028125 A1 10/2011
(Continued)

OTHER PUBLICATIONS

International Search Report dated Aug. 8, 2016 of international application PCT/EP2015/002379 on which this application is based.

*Primary Examiner* — Rakesh Kumar
(74) *Attorney, Agent, or Firm* — Walter Ottesen, P.A.

(57) ABSTRACT

A device is for ejecting at least one capsule from a capsule holder. The capsule holder has at least two capsule receptacles for, in each case, one capsule. The device comprises: at least two ejectors, each of the ejectors being configured to eject a respective one of the capsules from the corresponding one of the receptacles; a drive unit configured to actuate the at least two ejectors independently of each other in an ejection direction and in an opposite return direction; the drive unit having a pneumatic actuating cylinder for each ejector; the pneumatic actuating cylinders being individually actuatable as a drive for respective ones of the at least two ejectors; a limiter element which is provided jointly for a plurality of the at least two ejectors and which has a cyclical lifting drive; and, each ejector being assigned a stop acting in the return direction for the limiter element.

3 Claims, 6 Drawing Sheets

(51) Int. Cl.
*B65B 7/28* (2006.01)
*B65B 57/20* (2006.01)

(58) Field of Classification Search
USPC ..... 198/471.1, 397; 452/31; 221/10
See application file for complete search history.

(56) References Cited

U.S. PATENT DOCUMENTS

| | | | | | |
|---|---|---|---|---|---|
| 4,353,456 | A * | 10/1982 | Yamamoto | A61J 3/074 | 101/40 |
| 4,674,259 | A * | 6/1987 | Hills | B65B 39/007 | 53/202 |
| 5,174,088 | A * | 12/1992 | Focke | B65B 1/38 | 53/111 R |
| 5,377,867 | A * | 1/1995 | Schick | A01C 7/04 | 111/77 |
| 6,135,120 | A * | 10/2000 | Lofman | B65B 9/067 | 131/112 |
| 8,020,724 | B2 * | 9/2011 | Remis | B65B 5/103 | 221/211 |
| 8,266,874 | B2 * | 9/2012 | Runft | G01G 17/00 | 141/83 |
| 8,968,622 | B2 * | 3/2015 | Kuhnle | A61J 3/074 | 264/334 |
| 9,170,213 | B2 * | 10/2015 | Runft | A61J 3/074 | |
| 9,346,570 | B2 * | 5/2016 | Williams | B65B 9/20 | |
| 2007/0044433 | A1 * | 3/2007 | Runft | A61J 3/074 | 53/281 |

FOREIGN PATENT DOCUMENTS

| | | | | |
|---|---|---|---|---|
| JP | H0356202 | A | 3/1991 | |
| WO | WO-2005041849 | A1 * | 5/2005 | A61J 3/074 |

* cited by examiner

DEVICE AND METHOD FOR EJECTING AT LEAST ONE CAPSULE FROM A CAPSULE HOLDER

CROSS REFERENCE TO RELATED APPLICATIONS

This application is a continuation application of international patent application PCT/EP2015/002379, filed Nov. 26, 2015, designating the United States and the entire content of which is incorporated herein by reference.

FIELD OF THE INVENTION

The invention relates to a device for ejecting at least one capsule from a capsule holder, and to a method for ejecting at least one capsule from a capsule holder via such a device.

BACKGROUND OF THE INVENTION

Pharmaceutical preparations, food supplements or other substances are often administered in what are called two-piece capsules, which are intended to be swallowed by the user. Two-piece capsules are composed of a lower part, of an upper part fitted onto the latter, and of the preparation as filling. During production, the lower part is first of all filled with the desired content. It is then closed by attachment of the upper part. During the filling and closing operations, the capsule lower parts and the closed capsules, respectively, are held in a capsule holder, wherein such a capsule holder has at least two capsule receptacles for capsules, generally also many more than two receptacles. Such a capsule holder is driven cyclically to various stations at which, among other things, the capsules are filled and closed and the finished capsules are ejected.

To achieve a high degree of process reliability, use is also increasingly being made of test stations at which tests are carried out to check the correct filling and correct closure of the capsules and/or other quality features. In the context of a 100% check, acceptable capsules can be distinguished from unacceptable capsules and appropriate measures can be taken.

If at least one capsule within a capsule holder is identified as being unacceptable, a removal process is initiated. For this purpose, the capsule holder passes through two different ejection stations. The capsules found to be unacceptable are ejected in one ejection station, and the capsules found to be acceptable are ejected in the other ejection station and forwarded for further processing. Ejectors are located at the individual stations and eject the respective capsules from their capsule receptacles. Simple structures are often used in which all of the ejectors of one station are driven and moved jointly. Therefore, if at least one single capsule from the total number of capsules in the capsule holder is identified as being unacceptable, all of the capsules located at the same time in the capsule holder in this cycle are jointly ejected. However, if no capsule was identified as unacceptable, then all of the capsules at the associated ejection station are ejected simultaneously and forwarded for further processing. The structure of devices of this kind is indeed simple, but there can be an undesirably high rate of rejection.

In a departure from this, there is now an increasing requirement for the removal of individual capsules. Therefore, if one or more capsules within a set of capsules are identified as being unacceptable, it is only these unacceptable capsules that should be ejected individually and discarded, while the remaining acceptable capsules from the same set of capsules are intended to be separately ejected and made available for further processing.

This assumes that the individual ejectors assigned to a capsule holder can be actuated independently of each other, wherein the device includes a drive unit for actuating the ejectors independently of each other in an ejection direction and in an opposite return direction. However, the capsule receptacles within a capsule holder are often arranged very close to each other, such that little installation space is available for an individual drive of the individual ejectors. This is made even more difficult if the capsule receptacles are arranged in two or more rows in the capsule holder. In addition to there being little installation space available, a high level of operational reliability is needed in view of the high cycle rates, since malfunctions of individual ejectors not only impair the ejection of individual capsules, they can also lead to malfunctions of the entire filling machine, including blockages and machine damage.

SUMMARY OF THE INVENTION

It is an object of the invention to provide a device for ejecting at least one capsule from a capsule holder, the device permitting gentle and operationally reliable individual ejection of a capsule.

This object can, for example, be achieved by a device for ejecting at least one capsule from a capsule holder, wherein the capsule holder has at least two capsule receptacles for, in each case, one capsule. The device includes: at least two ejectors, each of the at least two ejectors being configured to eject a respective one of the capsules from the corresponding one of the receptacles; a drive unit configured to actuate the at least two ejectors independently of each other in an ejection direction and in an opposite return direction; the drive unit having a pneumatic actuating cylinder for each ejector; the pneumatic actuating cylinders being individually actuatable as a drive for respective ones of the at least two ejectors; a limiter element which is provided jointly for a plurality of the at least two ejectors and which has a cyclical lifting drive; and, each of the ejectors being assigned a stop acting in the return direction for the limiter element.

It is a further object of the invention to provide a method for ejecting at least one capsule from a capsule holder, the method permitting reliable operation of the device.

This object can, for example, be achieved by a method for ejecting at least one capsule from a capsule holder via a device; wherein the capsule holder has at least two capsule receptacles for, in each case, one capsule; wherein the device includes at least two ejectors, each of the at least two ejectors being configured to eject a respective one of the capsules from the corresponding one of the receptacles, a drive unit configured to actuate the at least two ejectors independently of each other in an ejection direction and in an opposite return direction, the drive unit having a pneumatic actuating cylinder for each ejector; the pneumatic actuating cylinders being individually actuatable as a drive for respective ones of the at least two ejectors; a limiter element which is provided jointly for a plurality of the at least two ejectors and which has a cyclical lifting drive; and, each of the ejectors being assigned a stop acting in the return direction for the limiter element. The method includes the steps of: constantly moving the limiter element to and fro via the cyclical lifting drive between a deployed position and a retracted position in the ejection direction and the return direction, respectively; in dependence upon whether an individual capsule has been identified as acceptable or unacceptable, deploying the piston rod of the respectively associated actuating cylinder in the ejection direction in such a manner that the associated one of the stops comes to bear on the limiter element and thereby limits the movement of the ejector in the ejection direction; and, ejecting the associated capsule from the corresponding capsule receptacle with the ejector as a result of the ejector's movement being limited in the ejection direction by the limiter element.

According to an aspect of the invention, provision is made that the drive unit includes, for each ejector, a pneumatic actuating cylinder which can be actuated individually, and a limiter element which is made available jointly for a plurality of the ejectors and in particular for all of the ejectors and which has a cyclical lifting drive, wherein each of the ejectors is assigned a stop that acts in the return direction for the limiter element.

In a method according to the invention, the limiter element is moved permanently to and fro, via its cyclical lifting drive, between a deployed position and a retracted position in the ejection direction and the return direction, respectively. Depending on whether an individual capsule has been identified as acceptable or unacceptable, the piston rod of the respectively associated actuating cylinder is deployed in the ejection direction in such a way that the associated stop comes to bear on the limiter element and thereby limits the movement of the ejector in the ejection direction. Via its movement limited in the ejection direction by the limiter element, the ejector now ejects the associated capsule from the capsule receptacle thereof.

According to an aspect of the invention, two drives are thus combined with each other. One of these two drives is formed by the pneumatic cylinders. These can be arranged and actuated parallel to each other in a space-saving manner, such that an individual and mutually independent movement of the individual ejectors can still be obtained even when there is only a very small installation space available.

However, the pneumatic cylinders have a system-related disadvantage. As soon as a working pressure is applied to one side or the other of the piston, there is a very rapid movement of the piston rod, the speed of which cannot be adjusted or limited with satisfactory precision and reproducibility by pneumatic means alone. In the ejection direction in particular, too rapid a movement can damage the capsules, while attempting to throttle the pneumatic speed entails the danger of the piston rods moving too slowly and being unable to fulfill their function. This is where the action of the limiter element comes into play. Since it is configured or made available to act simultaneously on a plurality of the ejectors and in particular on all of the ejectors, there is also just one limiter element present, or just a small number of them. Accordingly, only a single cyclical lifting drive is needed, or only a small number of such drives, and therefore the installation limitations in respect of the individually actuatable ejectors and pneumatic actuating cylinders do not apply here.

The limiter element is now moved permanently to and fro, via its cyclical lifting drive, between the deployed position and the retracted position, and, as long as the pneumatic cylinders remain unactuated in their recovered rest position, it is without function. If, however, on the basis of the above-described identification of acceptable and unacceptable capsules, one or more actuating cylinders are actuated in the ejection direction, the associated stops come to bear on the limiter element. The limiter element, which is adjusted in speed and amplitude in a clearly defined manner by the enforced movement of its own electromotive drive, thus limits the pneumatically initiated movement of the piston rods and of the ejectors in the same way. The ejection speed is thus predefined by the kinematics of the limiter element independently of the pneumatic operating pressure. A sufficient pneumatic operating pressure simply has to be made available that is able to press the stops, when so required, against the limiter element. Thus, with the jointly acting limiter element, the limitation of the deployment speed and, if appropriate, the limitation of the deployment path of the individually actuated pneumatic cylinders ensure a reliable ejection of the selected capsules, without overloading them, while at the same time the individual actuatability of the individual pneumatic cylinders and ejectors is maintained.

In the context of the disclosure, a return travel of one or more deployed ejectors and of the associated actuating cylinder can also be effected via the limiter element. If no pneumatic return travel is provided, the limiter element acts as a mechanical enforced return means. However, in standard or regular operation, the return of the deployed ejector is expediently effected pneumatically via the associated actuating cylinder, as a result of which the mechanical loading and performance requirements of the limiter element are reduced. It is only in the event of a malfunction, in which the pneumatic return is not effected as intended or cannot be performed, that the return of the deployed ejector and of the associated actuating cylinder takes place via the limiter element, automatically through the limiter element coming into contact with the respective stop, wherein the return movement of the limiter element in the return direction acts on the respective stop. It is thus reliably ensured that none of the ejectors and actuating cylinders can remain in the deployed position and thereby impede the correct onward operation.

As regards the configuration of the limiter element, various structures come into consideration in the context of the disclosure. In an advantageous embodiment, the limiter element includes a main body with limiter projections protruding from the latter, wherein the limiter projections are configured to bear on the stops. Through the movement of the main body, all of the limiter projections experience the same movement path, such that there is an automatic synchronization of the movement of individual ejectors and actuating cylinders. Various structures also come into consideration as regards the ejectors, for example in the form of rocker arms or the like. The ejectors are preferably configured as axially movable rams, wherein, for each piston rod, an associated ram and an associated stop form a functional unit that is jointly coaxially movable and linearly guided. The coaxial configuration saves space, has a simple structure and is functionally reliable. Moreover, an interaction with the limiter element can be easily achieved.

It may be expedient for the limiter projections to be oriented radially in relation to the respective rams and stops. In a preferred embodiment, several rams are arranged in a row with the associated stops, wherein the limiter projections are guided through between the rams. Such an arrangement is not sensitive to position tolerances and ensures that the pneumatically moved units always come to bear with their stops, in a reproducible manner, on the limiter projections of the limiter element. To further support this aim, the stops are each formed by an annular flange. The configuration as an annular flange ensures the effect even when an inadvertent rotation of the respective structural part about its longitudinal axis has taken place.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
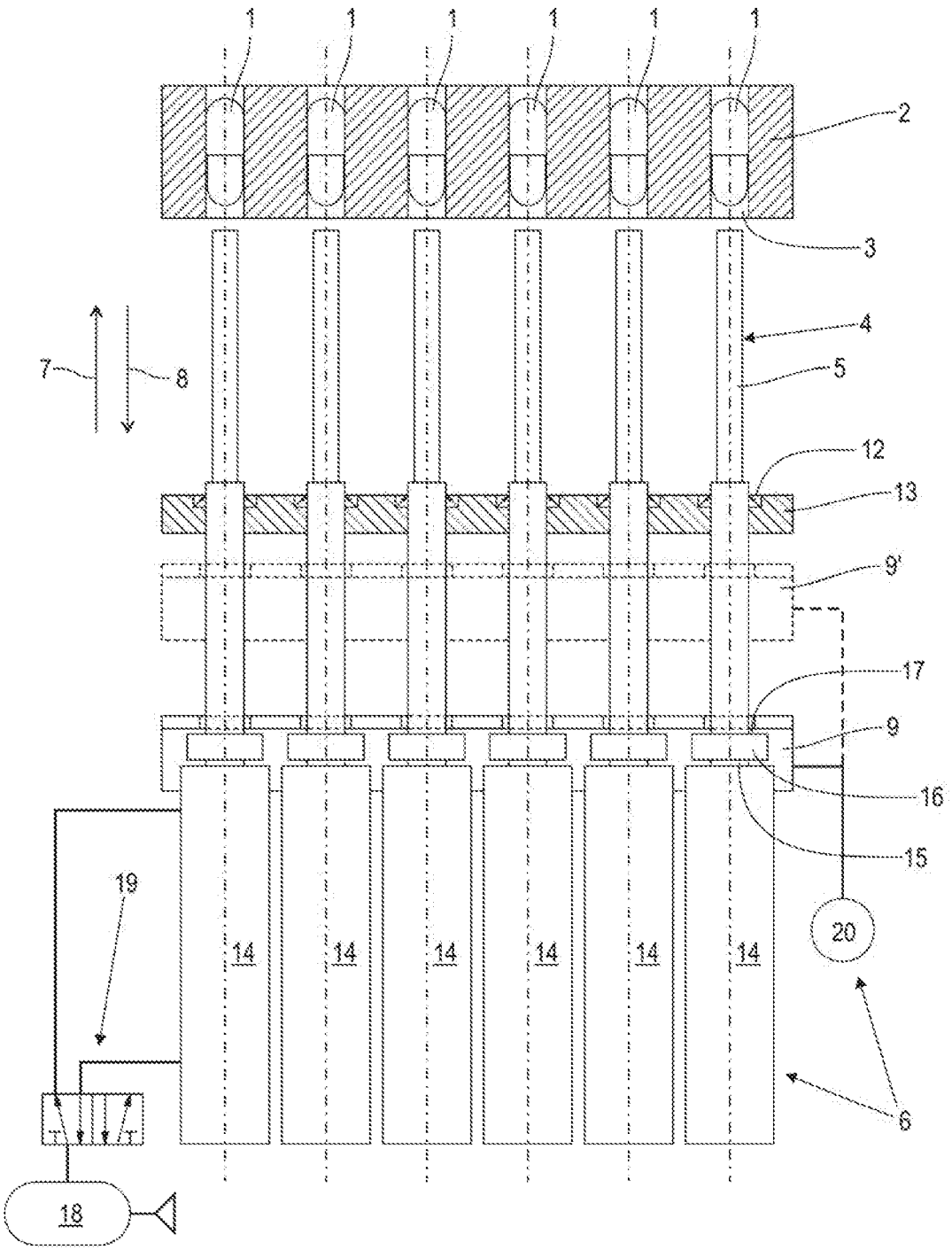
FIG. 1 shows a schematic front view of a device for ejecting at least one capsule from a capsule holder, with ejectors which can be actuated individually and pneumatically, and which are located in a rest position, and with a limiter element moved up and down permanently in operation.

FIG. 1 shows a schematic front view of a device configured according to an embodiment of the invention for ejecting at least one capsule 1 from a capsule holder 2. The device shown is part of a capsule-filling installation with a plurality of stations at which the capsules are filled with their intended contents, closed, checked and then forwarded for further processing, for example packaging in a blister pack or the like. For this purpose, the capsule holder 2 is provided with a plurality of continuously open capsule receptacles 3, wherein the capsule holder 2 shown here has, simply by way of example, a row of six capsule receptacles 3. Any other desired number may also be expedient. In addition, two or more such rows with capsule receptacles 3 arranged like a matrix may also be expedient in the context of the disclosure.

At a filling station (not shown), each capsule receptacle 3 initially contains only a capsule lower part, which is open at the top and which is then filled with a suitable quantity of a pharmaceutical powder, a food supplement or another desired content. At an onward closure station (likewise not shown), a capsule upper part is then fitted respectively onto each of the capsule lower parts, such that finished capsules 1 according to the view in FIG. 1 are formed. In addition, the capsule holder 2 passes through a test station (likewise not shown). Suitable sensors are provided there which, for each individual capsule 1, are able to detect possible capsule defects in the form of damage to the capsule shell or in the form of an insufficient filling or lack of any filling. In the context of a 100% check, it is thus possible to identify whether, and in which capsule receptacle 3, there is an acceptable capsule or an unacceptable capsule 1. Depending on this identification of an acceptable capsule or an unacceptable capsule, individual capsules 1 are intended to be ejected from their respective capsule receptacles 3 at the ejection station shown here.

For this purpose, the device according to an aspect of the invention has an identical number of ejectors 4 corresponding to the number of capsule receptacles 3. In addition, the device includes a drive unit 6 for actuating the ejectors 4 independently of each other in an ejection direction 7 and in an opposite return direction 8.

The drive unit 6 is in two parts. A first part of the drive unit 6 is formed by pneumatic actuating cylinders 14, each of them with an axially movable piston rod 15, wherein a respective actuating cylinder 14 is functionally assigned to each ejector 4, and wherein the actuating cylinders 14 can be actuated individually, that is, independently of each other.

Each structural unit composed of actuating cylinder 14 and ejector 4 moreover includes a stop 17, which is configured to bear on a limiter element 9 and which, when it bears thereon, acts on the structural unit in the return direction 8 or exerts a force in the return direction 8. The stops 17 are formed here by the front faces of annular flanges 16 directed toward the limiter element 9, wherein such an annular flange 16 is arranged in each case between the piston rod 15 and the ejector 4 in relation to the axial direction. However, the stops 17 or annular flanges 16 can also be positioned on the piston rods 15, the ejectors 4, or optional connection elements (not shown) between these.

A second part of the drive unit 6 is formed by the limiter element 9 with a cyclical lifting drive 20. The cyclical lifting drive 20, which is shown only schematically here, can be formed, for example, by an electromotive drive, for example with a geared motor, crank and connecting rod. Of course, linear motors or the like also come into consideration. Particulars of a preferred embodiment of the lifting drive 20 with a cam disk 21 are shown in FIG. 6 and are described in more detail below. The lifting drive 20 is in any case configured in such a way that, during operation, the limiter element 9 is moved cyclically and permanently to and fro in a constrained motion between a retracted position, represented by a solid line, and a position shown by a broken line and designated by 9', in the ejection direction 7 and the return direction 8, respectively. For example, by controlling the speed of the lifting drive 20, it is possible for at least the lifting speed, if appropriate also the lifting amplitude, to be precisely predefined. The function of the limiter element 9 will become clear from the description below with reference to FIGS. 2 to 5.

The ejectors 4 can be ejector levers or the like and, in the illustrative embodiment shown, are configured as linearly or axially movable rams 5, which are guided individually in an axially movable manner in linear guides 12 of a table 13. The pneumatic actuating cylinders 14 can act on the respectively associated ejectors 4 indirectly via deflection levers or the like. In the illustrative embodiment shown, a piston rod 15 of an actuating cylinder 14, an associated ram 5 and an associated stop 17 are arranged coaxially to each other and rigidly connected to each other, wherein a one-piece configuration may also be expedient. In addition, the coaxial structural units, or at least the rams 5, are oriented coaxially to the respective capsule receptacles 3 in order to be able to be driven into these, if so required, for the purpose of ejecting the capsule.

As has already been mentioned, the actuating cylinders 14 can be operated individually and independently of each other. For this purpose, a control valve 19 is assigned to each individual actuating cylinder 14. For the sake of clarity, only one control valve 19 is shown by way of example here for one of the actuating cylinders 14. The pneumatic actuating cylinders can be self-resetting, single-action cylinders, wherein the actuation in the ejection direction 7 is effected pneumatically and the actuation in the return direction is effected by a spring force. Instead of a return movement by a spring force, a return can also be effected via the limiter element 9 according to FIG. 5. However, in the illustrative embodiment shown, the pneumatic actuating cylinders 14 are configured as dual-action cylinders with pneumatic attachments for the pneumatic actuation both in the ejection direction 7 and also in the return direction 8. Depending on the desired direction of actuation, the associated pneumatic attachments of the actuating cylinders 14 are brought into communication with a compressed-air source 18 via the respective control valve 19. For this purpose, in the illustrative embodiment shown, the control valve 19 is configured as a 5/2 valve. However, other configurations of the control valve 19 may also be expedient. At any rate, the driving of the control valves 19 and therefore the individual ejection or return movement of the actuating cylinders 14 and of the ejectors 4 are effected via a control unit (not shown) in a manner that is dependent on a previous identification of acceptable/unacceptable capsules 1 in the capsule receptacles 3 of the capsule holder 2.

FIG. 1 shows the device according to an embodiment of the invention in its normal state, in which all of the capsules 1 located in the capsule holder 2 have been identified as being acceptable or in accordance with requirements. In this case, all of the ejectors 4 are located in an inactive rest position in which they are drawn back in the return direction 8. The same also applies to the piston rods 15 of the actuating cylinders 14 and to the stops 17. For this purpose, the return side of the actuating cylinders 14 is subjected to pressure via the control valves 19, such that all of the actuating cylinders 14 are retracted in the return direction 8 and are maintained under pressure in this retracted position. Of course, a reverse set-up is also possible, in which the retracted position of the ejectors 4 corresponds to a deployed state of the actuating cylinders 14. The effect is that, in this normal state, the stops 17 do not come to bear on the limiter element 9. The limiter element 9 for its part, in the method according to an embodiment of the invention, is moved permanently to and fro via its cyclical lifting drive between the deployed position and the retracted position. In the normal case shown here in FIG. 1, it exerts no effect, since there is no contact with the stops 17. None of the capsules 1 is ejected here from the capsule holder 2. Rather, an ejection of the capsules 1 takes place at a subsequent work station (not shown) where the capsules that have been identified as acceptable and have been ejected are forwarded for further processing.

Figure 2:
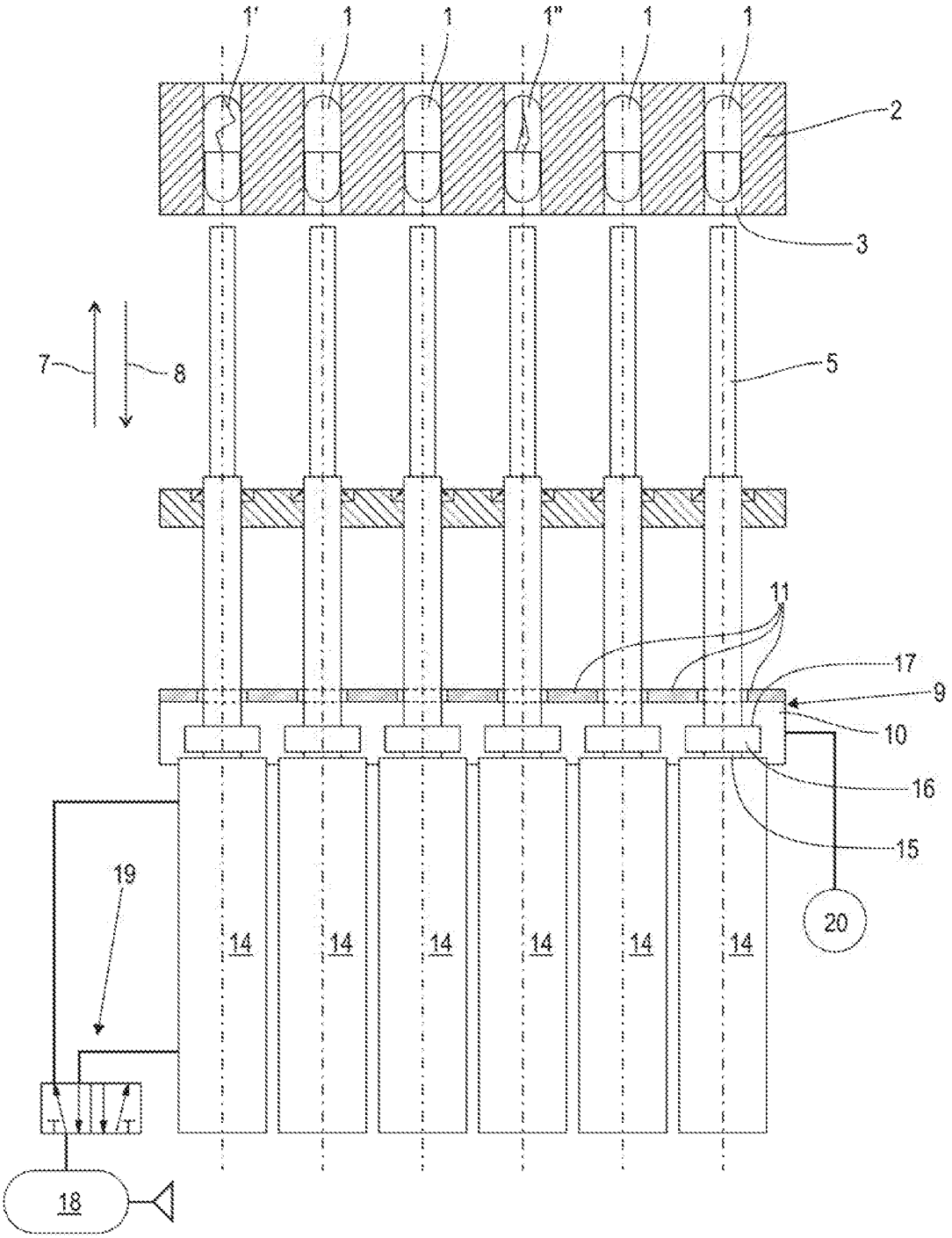
FIG. 2 shows the arrangement according to FIG. 1, with two capsules identified as unacceptable even before the ejection procedure has begun.
Figure 3:
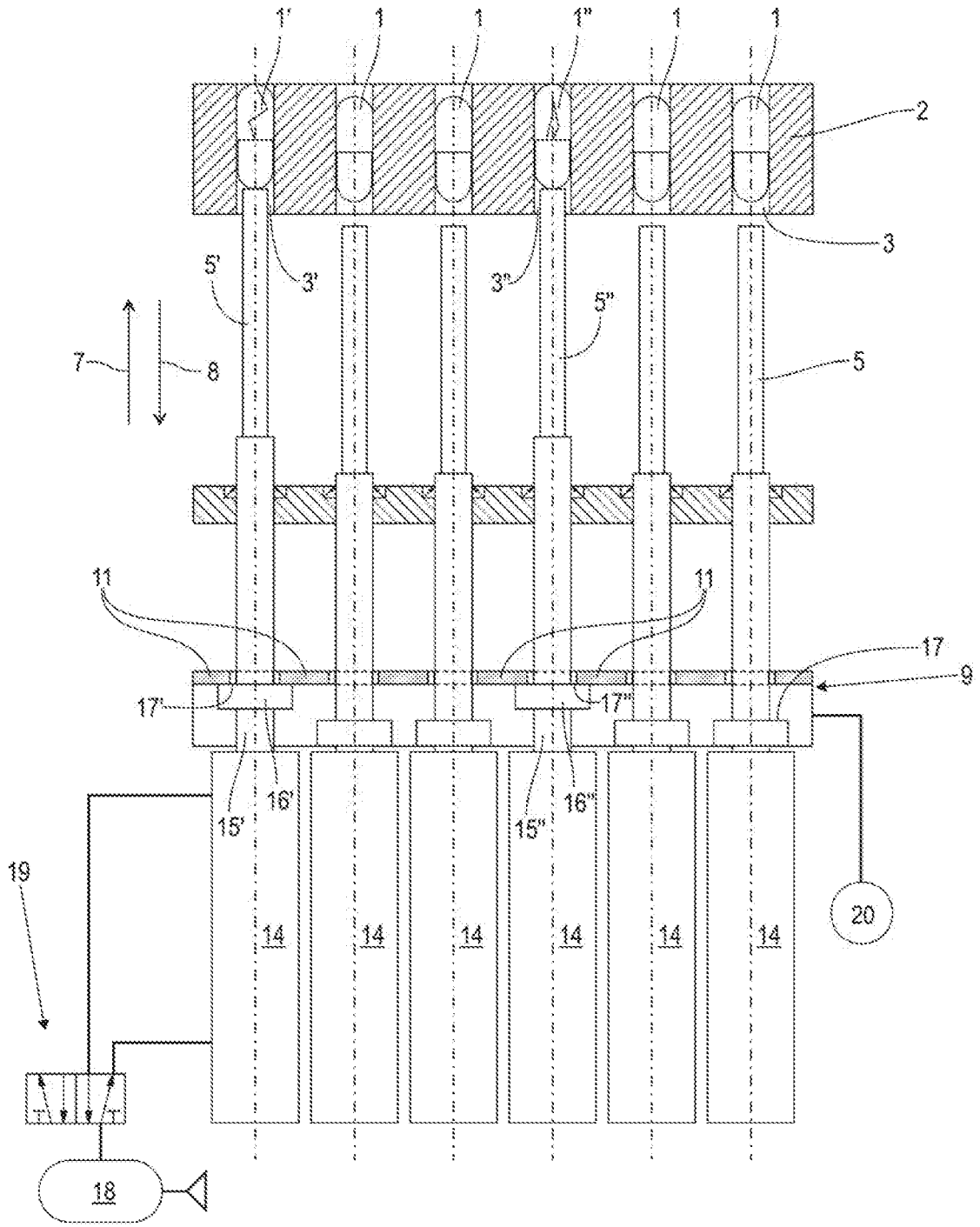
FIG. 3 shows the arrangement according to FIG. 2, with two ejectors which are assigned to the unacceptable capsules and which, at the start of their ejection procedure, bear on the limiter element.
Figure 4:
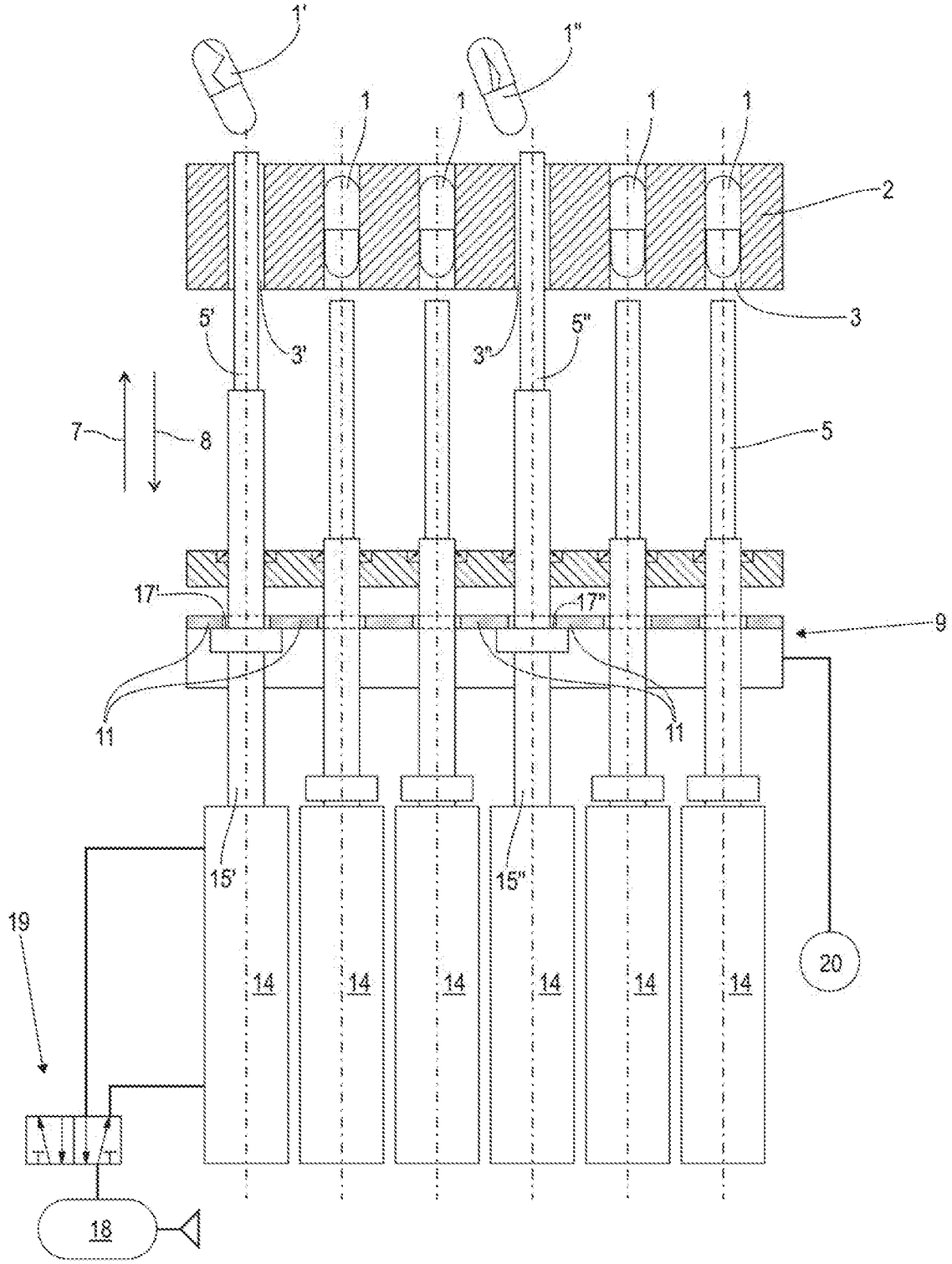
FIG. 4 shows the arrangement according to FIGS. 2 and 3 in the fully deployed state of the ejectors, with unacceptable capsules that have been ejected.

FIGS. 2 to 4 are sequential phase images showing the device according to FIG. 1 for the different case in which at least one capsule 1', here for example two capsules 1', 1", has/have been identified as being defective. For illustration purposes, the defective capsules 1', 1" have been shown here by way of example with cracks in the capsule shell. Of course, other detectable types of defect also come into consideration, for example an inadequate filling or absence of filling of the capsules 1', 1". At any rate, via the device and the method, provision is made that the capsules 1', 1" identified as unacceptable are separated individually from the capsules 1 identified as acceptable via an individual capsule ejection procedure.

For the sake of clarity, FIG. 2 shows only the case in which the result of the capsule test (not shown) is that two specified capsules 1', 1" are unacceptable, whereas the remaining capsules 1 have been identified as being acceptable and in order. This is followed by individual actuation of the pneumatic actuating cylinders 14 assigned to the unacceptable capsules 1, 1", wherein the actuating cylinders 14 according to FIG. 2 have however remained in their retracted position. In the context of the cyclical reciprocating motion, however, a movement of the limiter element 9 in the ejection direction 7 has begun.

This FIG. also reveals a structural detail whereby the limiter element 9 includes a main body 10 with limiter projections 11 protruding from it perpendicularly with respect to the drawing plane, wherein the limiter projections 11 are configured to bear on the stops 17. It can also be seen here, in line with FIG. 1, that a peripheral annular flange 16 is in each case arranged between the piston rods 15 and the associated rams 5 in relation to the axial direction. With their ends directed toward the rams 5, the annular flanges 16 each form the associated stop 17. The rams 15 are arranged at equidistant intervals in a row. The limiter projections 11 of the limiter element 9 are guided through between the rams 5 perpendicularly with respect to the drawing plane and therefore perpendicularly with respect to the plane spanned by the rams 5. Moreover, there is also a limiter projection 11 at each of the two outer sides of the row of rams 5, such that a pair of limiter projections 11 in each case engages like a fork around each individual ram 5. The width and spacing of the limiter projections 11 and of the stops 17 are adapted to each other in such a way that each stop 17 can come to bear on a respective pair of limiter projections 11.

Proceeding from the initial position according to FIG. 2, the rams 5', 5" assigned to the capsules 1', 1" that have been identified as unacceptable are now moved in the ejection direction 7. This can apply in respect of a single unacceptable capsule 1', but also in respect of a plurality or even all of the capsules located in the capsule holder 2. At any rate, the control valve 19 assigned to the respective actuating cylinder 14 is for this purpose switched according to FIG. 3 in such a way that the individually associated piston rods 15', 15" are deployed in the ejection direction 7. The same also applies of course to the annular flanges 16', 16" connected to them, to the stops 17' 17" arranged on the latter, and to the rams 5, 5" connected to the latter. The pneumatic movement of the piston rods 15', 15" is, however, potentially faster than the mechanically predefined reciprocating motion of the limiter element 9 in the ejection direction 7. Consequently, the stops 17', 17" bear on the associated limiter projections 11 of the limiter element 9. Via its limiter projections 11, the limiter element 9 applies a force to the stops 17', 17" in the return direction 8, as a result of which the deployment speed of the rams 5', 5" is limited and synchronized with the speed of movement of the limiter element 9 in the ejection direction 7. In this way, the actuated rams 5', 5" make contact, at a limited speed, with the capsules 1', 1" that are to be ejected according to the view in FIG. 3.

FIG. 4, as the next phase image, shows the same device when the limiter element 9, in the context of its cyclical movement, has reached its position of maximum deployment in the ejection direction 7. The stops 17', 17" associated with the rams 5', 5" still bear on the limiter projections 11 of the limiter element 9, such that the amplitude of the reciprocating motion of the activated rams 5', 5" is also limited by this. The activated rams 5', 5" have at any rate reached their maximum deployment in the ejection direction 7, in such a way that the capsules 1', 1" identified as unacceptable are ejected.

Figure 5:
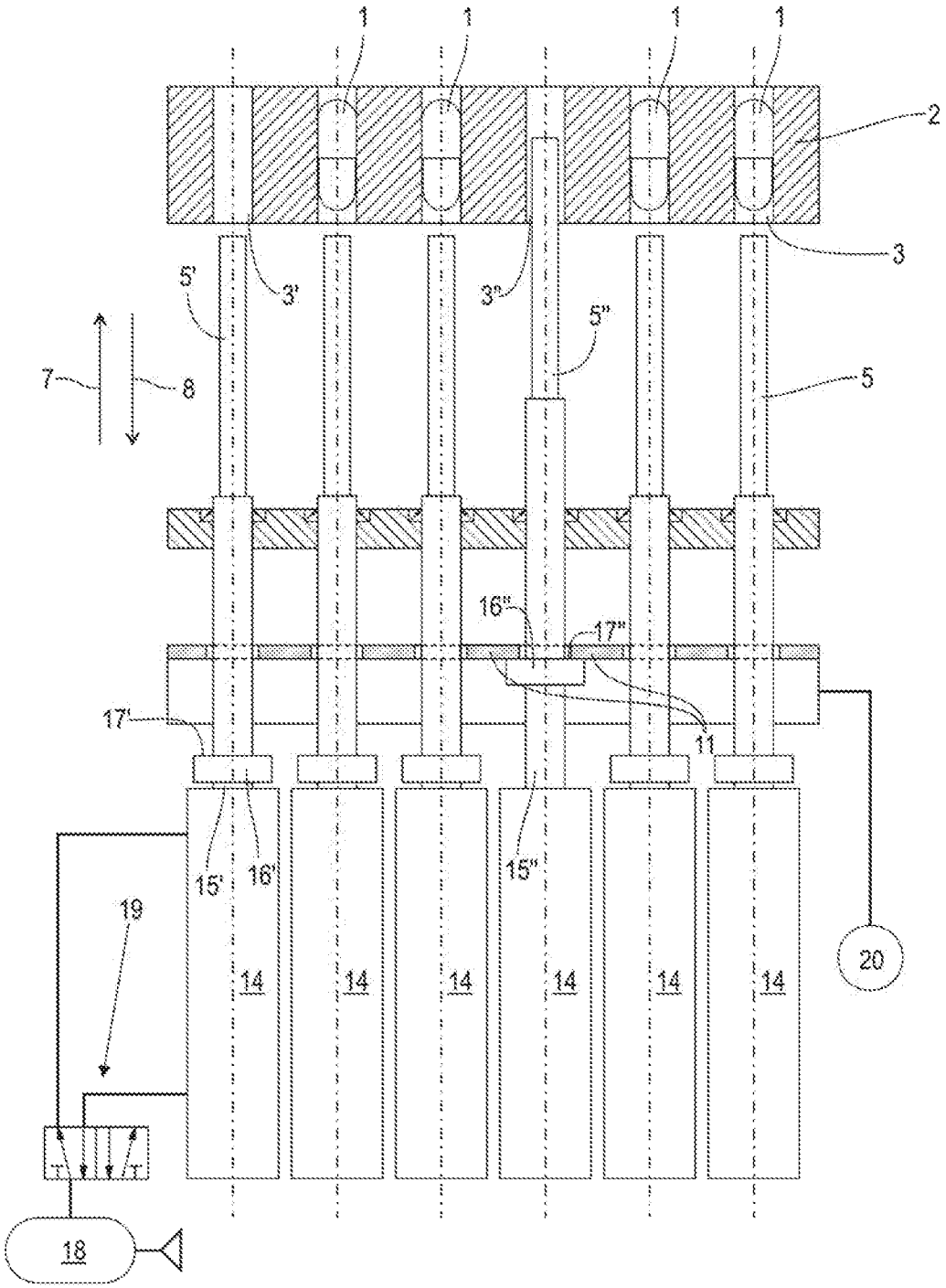
FIG. 5 shows the arrangement according to FIGS. 2 to 4 after the ejection procedure, with a pneumatically retracted ejector, and with an ejector that has been retracted by force via the limiter element; and, FIG. 6 shows a schematic side view of the arrangement according to FIGS. 1 to 5, with details of the configuration of the lifting drive with a cam disk.
Figure 6:
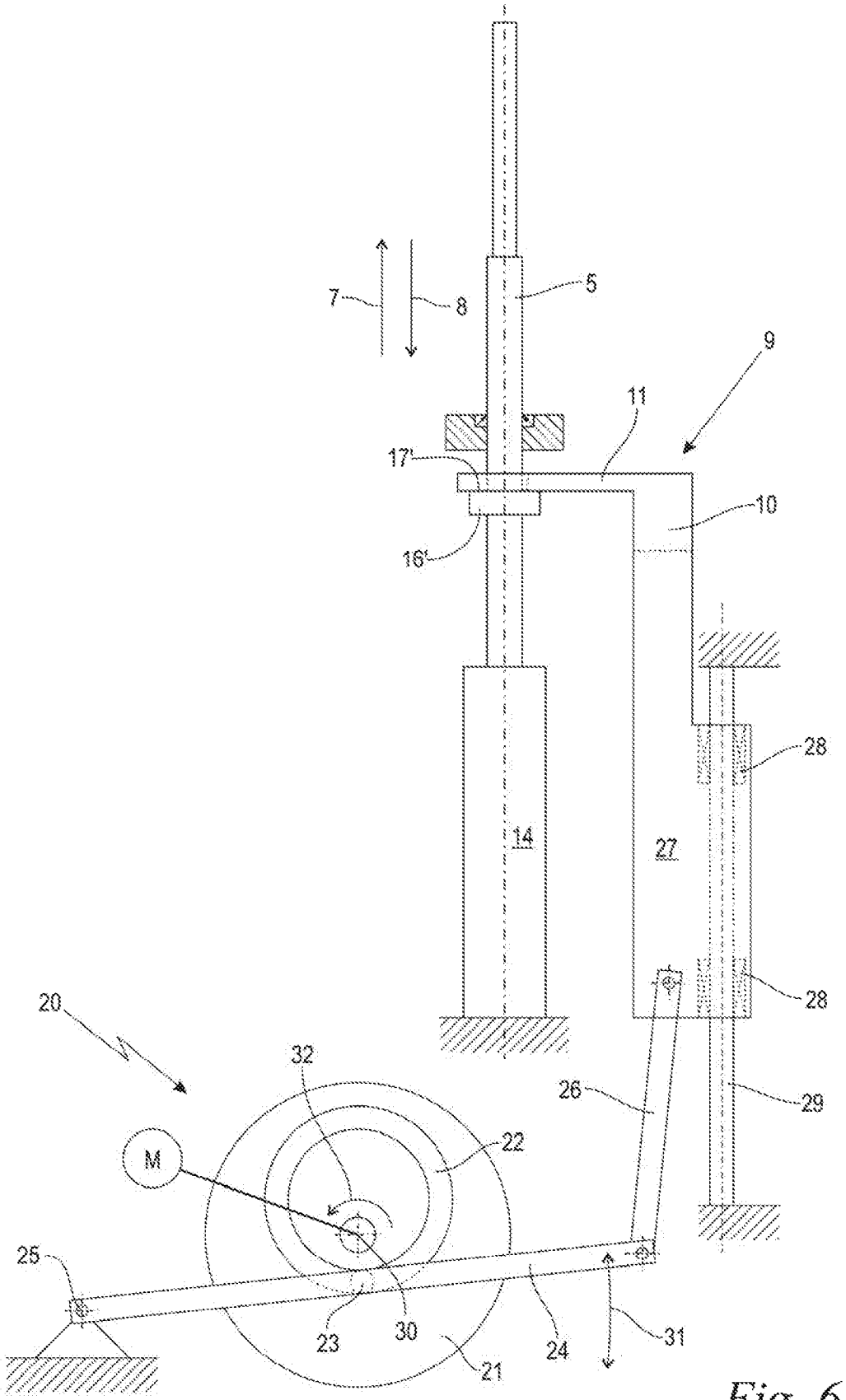

The return movement of the deployed rams 5', 5" now proceeds as shown in the next phase image according to FIG. 5. The control valves 19 assigned to the previously deployed rams 5', 5" are switched back again to the starting position according to FIGS. 1 and 2, as a consequence of which the piston rods 15', 15" with the associated annular flanges 16', 16" and rams 5', 5" are driven inward in the return direction 8. In the context of its cyclical reciprocating motion, the limiter element 9 also executes a movement in the return direction 8. However, the pneumatically induced inward movement of the piston rods 15', 15" is generally faster than the return movement of the limiter element 9 such that, in regular operation, the stops 17', 17" lift away from the limiter element 9. Therefore, in regular operation, the limiter element 9 has no effect on the return movement of the previously actuated rams 5', 5".

However, the eventuality of a malfunction is also taken into consideration, as is shown by the example of the ram 5" in FIG. 5. While the previously actuated ram 5' has been correctly withdrawn pneumatically from its associated capsule receptacle 3' via its actuating cylinder 14, the same has not happened, or has not happened quickly enough, for the ram 5". The latter still protrudes at least partially into its associated capsule receptacle 3". If the capsule holder 2 were now to be moved onward in the next work cycle to the subsequent processing station for ejection of the acceptable capsules 1, the capsule holder 2 would collide with the still at least partially deployed ram 5". To avoid such a collision, the limiter element 9 therefore bears with its limiter projections 11 on the associated ram 17" even in its downward movement in the return direction 8 and enforces an inward movement of the ram 5" in the return direction 8 together with the limiter element 9.

From the above comments regarding the function of the limiter element 9, it thus emerges in other words that a limiter element 9 is made available for a plurality of ejectors 4. "Made available" here means that it does not necessarily have to interact with one of the ejectors 4 in the normal case according to FIG. 1, but that, in the case of the actuated cylinders according to FIGS. 2 to 5, it interacts with the actuated ejectors 4. By way of example, one limiter element 9 is shown here for all of the ejectors 4. However, it may also be expedient, for example in a configuration with two rows of capsule receptacles 3 and ejectors 4, to provide two such limiter elements 9, that is, one limiter element 9 for each row of capsule receptacles and ejectors 4. However, in other embodiments, two or more limiter elements 9 may also be advantageous with one common lifting drive or with a plurality of lifting drives 20.

Thereafter, the capsule holder 2, with the remaining capsules 1 identified as acceptable, is forwarded to a subsequent processing station, where the acceptable capsules 1 are then ejected and for example packaged.

The selective ejection of capsules 1', 1" from their capsule receptacles 3, 3", with the remaining capsules 1 being maintained in their associated capsule receptacles 3, is shown here in the example in which unacceptable capsules 1, 1' are first of all ejected while the acceptable capsules 1 remain in the capsule holder 2. In the context of the disclosure, a reverse procedure is of course also possible, in which the capsules 1 found to be acceptable are selectively ejected in an analogous manner while the capsules 1', 1" found to be unacceptable initially remain in their capsule receptacles 3, 3" and are then discarded at a subsequent station.

FIG. 6 shows a schematic side view of the arrangement according to FIGS. 1 to 5 with details of the configuration of the lifting drive 20. The lifting drive 20 includes what is in this case an electric drive motor M, and a cam disk 21 which is driven in rotation by the drive motor M about a rotation axis 30 according to the arrow 32. On its end face, the cam disk 21 has a circumferential groove 22 arranged eccentrically in relation to the rotation axis 30. Parts of the lifting drive 20 also include a rocker arm 24 which at one end is mounted rigidly on the apparatus via a fixed bearing 25 and which at its opposite end is connected to the limiter element 9 via an articulated connecting rod 26. Between the fixed bearing 25 and the articulated connection to the connecting rod 26, for example approximately half way between them here, a guide pin 23 is arranged on the rocker arm 24 and engages in the eccentric groove 22. As a result of the eccentric circumferential movement of the groove 22, the guide pin 23, and with it the entire rocker arm including its articulated connection to the connecting rod 26, exerts a cyclically oscillating pivoting or tilting movement according to a double arrow 31, with the fixed bearing 25 as the center point. Since the engagement of the guide pin 23 in the eccentric groove 22 is practically free of play, the pivoting or tilting movement is a constrained movement with no possibility of deviation.

The main body 10 of the limiter element 9 is adjoined by guide portions 27 with bearings 28, via which the limiter element 9 is mounted on linear guides 29. At its end opposite the rocker arm 24, the connecting rod 26 is connected to the limiter element 9 via a joint. In this way, the connecting rod 26 transmits the cyclically oscillating pivoting or tilting movement of the rocker arm 24 to the limiter element 9, in such a way that the latter executes the above-described cyclically oscillating reciprocating motion in the ejection direction 7 and the return direction 8.

Finally, a further detail that can be seen from the side view according to FIG. 6 is that the limiter projections 11 do not only engage around the respective ram 5 on both sides but also, starting from the main body 10, extend beyond the respective annular flange 16 and the stop 17 formed by the latter. This ensures the greatest possible surface area across which the limiter projections 11 bear on the stop 17.

It is understood that the foregoing description is that of the preferred embodiments of the invention and that various changes and modifications may be made thereto without departing from the spirit and scope of the invention as defined in the appended claims.

What is claimed is:

1. A method for ejecting at least one capsule from a capsule holder via a device; wherein the capsule holder has at least two capsule receptacles for, in each case, one capsule; wherein the device includes at least two ejectors, each of the at least two ejectors being configured to eject a respective one of the capsules from the corresponding one of the receptacles, a drive unit configured to actuate said at least two ejectors independently of each other in an ejection direction and in an opposite return direction, the drive unit having a pneumatic actuating cylinder for each ejector; the pneumatic actuating cylinders being individually actuatable as a drive for respective ones of the at least two ejectors; a limiter element which is provided jointly for a plurality of said at least two ejectors and which has a cyclical lifting drive; and, each of the ejectors being assigned a stop acting in the return direction for said limiter element, the method comprising the steps of:

constantly moving the limiter element to and fro relative to the pneumatic actuating cylinders via the cyclical lifting drive between a deployed position and a retracted position in the ejection direction and the return direction, respectively;

in dependence upon whether an individual capsule has been identified as acceptable or unacceptable, deploying the piston rod of the respectively associated actuating cylinder in the ejection direction in such a manner that the associated one of the stops comes to bear on the limiter element and thereby limits the movement of the ejector in the ejection direction; and, ejecting the associated capsule from the corresponding capsule receptacle with the ejector as a result of the ejector's movement being limited in the ejection direction by the limiter element.

2. The method of claim 1, wherein the return of the deployed ejector and of the associated actuating cylinder is effected via the limiter element.

3. The method of claim 2, wherein:

in regular operation, the return of the deployed ejector is effected pneumatically via the associated actuating cylinder; and, in the event of a malfunction, the return of the deployed ejector and of the associated actuating cylinder is effected via the limiter element.

* * * * *